US009656283B2

(12) United States Patent
Croser

(10) Patent No.: US 9,656,283 B2
(45) Date of Patent: May 23, 2017

(54) SPRINKLER PROTECTOR

(76) Inventor: Damien Croser, Monbulla (AU)

( * ) Notice: Subject to any disclaimer, the term of this patent is extended or adjusted under 35 U.S.C. 154(b) by 275 days.

(21) Appl. No.: 13/530,658

(22) Filed: Jun. 22, 2012

(65) Prior Publication Data

US 2012/0325931 A1 Dec. 27, 2012

(30) Foreign Application Priority Data

Jun. 24, 2011 (AU) ..... 2011902480

(51) Int. Cl.
*B05B 15/00* (2006.01)
*B05B 3/00* (2006.01)

(52) U.S. Cl.
CPC ..... *B05B 15/001* (2013.01); *B05B 3/00* (2013.01)

(58) Field of Classification Search
USPC ..... 239/288, 288.3, 288.5, 273–285, 498, 239/504, 518, 723, 726, 728; D23/214, D23/227
See application file for complete search history.

(56) References Cited

U.S. PATENT DOCUMENTS 1,469,336 A * 10/1923 Rowley ..... A62C 37/08 169/51
3,514,040 A * 5/1970 Carson ..... 239/288.5
3,727,695 A * 4/1973 Danton ..... 169/37
3,797,746 A * 3/1974 Gray et al. ..... 239/288.5
3,801,014 A * 4/1974 Cantales ..... 239/104
4,025,045 A 5/1977 Kubiak
4,095,744 A * 6/1978 Villelli ..... 239/1
4,212,426 A 7/1980 Choi
4,700,890 A * 10/1987 Hasegawa ..... 239/103
5,050,801 A * 9/1991 Ferrari ..... 239/211
5,458,290 A * 10/1995 Johnson ..... 239/203
6,382,525 B1 * 5/2002 Santiesteban et al. .. 239/222.11
7,677,475 B2 * 3/2010 Lawyer ..... 239/523
2003/0001031 A1 * 1/2003 Heldt ..... B05B 5/04 239/700
2003/0173094 A1 * 9/2003 Vinson et al. ..... 169/37
2004/0065753 A1 4/2004 Corbett
2007/0256844 A1 * 11/2007 Blasing et al. ..... 169/51

FOREIGN PATENT DOCUMENTS

CN 101745478 6/2010

* cited by examiner

*Primary Examiner* — Arthur O Hall
*Assistant Examiner* — Cody Lieuwen
(74) *Attorney, Agent, or Firm* — Sand & Sebolt

(57) ABSTRACT

A sprinkler protector including a housing which engages with a sprinkler or sprinkler pipe and a plurality of circumferentially disposed fingers forming a cage-like shroud over the sprinkler head. The protector shields the sprinkler from impact with foreign material but does not prevent the efficient spraying of water from the sprinkler for the purposes of irrigation.

19 Claims, 7 Drawing Sheets

SPRINKLER PROTECTOR

FIELD OF THE INVENTION

This invention relates to a sprinkler protector.

BACKGROUND TO THE INVENTION

Sprinklers used in agriculture for the irrigation of large fields or crops are common and typically comprise a long water conduit which is pivotally connected at one end to a source of water under pressure. The conduit arm is carried in an elevated position by a plurality of spaced wheels or wheel towers which are powered by hydraulic, pneumatic or electric motors to sweep the central conduit over a field. The conduit includes a plurality of water sprinkling heads spaced over its length for distributing a spray of water over the field area as the conduit passes by. There are also other types of irrigation systems where the conduit arm moves in a linear direction with a source of water supplied by a hose that follows the conduit.

It is common in such systems for the sprinkler head to be attached via drops, or fluid conduits which extends from the conduit arm downwards towards the ground. This brings the sprinkler head close to the ground to prevent or minimise evaporation of the water before contact with the crops is achieved. However this proximity of the sprinkler head to the crops can result in the sprinkler head impacting or being dragged through the crops themselves, damaging the sprinkler head or otherwise allowing foreign matter such as dirt and plant debris to be caught inside the sprinkler head. A buildup of this material can clog the sprinkler head and block the escape of water. As the irrigation systems often travel across fields, the sprinkler heads can impact on fences, other barricades, livestock and other equipment potentially causing further damage.

Efforts have been made to prevent such damage through attaching sheath-like collars to the sprinkler head in order to protect the sprinkler. However, such covers do not prevent the build-up of mud or other matter and thus blockages can still be an issue. Such covers also inhibit the escape of water from the sprinklers and thus make the system less efficient.

The object of this invention is therefore to provide a cage or open shroud for a sprinkler which protects the sprinkler head and that alleviates the above problems, or at least provides the public with a useful alternative.

SUMMARY OF THE INVENTION

Therefore in one form of the invention there is proposed a sprinkler protector comprising a housing, a plurality of circumferentially disposed fingers extending from the housing wherein said protector is adapted to enclose a sprinkler;

In preference, the housing is conical, the base of the said housing is hexagonal and comprises equilateral arches, said fingers extend downwardly between each arch;

In preference, said fingers contain shoulders extending upwardly over the base of the housing;

In preference, the neck of the said housing smoothly forms into the shoulder of said fingers and does not contain any external catching points or sharp edges;

In preference, the base contains six evenly circumferentially spaced fingers extending downwardly from the said base forming a cylindrical space therein;

In preference, the said housing containing an aperture at its apex, said aperture enclosing a drop pipe and said fingers enclosing a sprinkler head.

In preference, the said protector is constructed from first and second identical halves, each containing a semi-circular flange, a co-axial threaded inner bore, the first half containing a male key and the second half containing a female key, wherein the flanges create a ring around the drop pipe, the male and female keys are mated and screws are threaded into the bores to connect the parts together;

In preference, the said protector comprises first and second identical halves with a molded hinge joining the first and second halves on one side of the said housing and a connecting clip adapted to join the non-molded sides of the said housing together enclosing the sprinkler;

In preference, the said fingers are comprised of radially extending webs from the centre axis inwardly tapered towards the said sprinkler;

In preference, the said fingers elevate the said sprinkler away from an impacting surface; and In preference, the fingers of the sprinkler protector further comprise oblate paddles; said paddles being located transversely to the distal end of the webs.

It should be noted that any one of the aspects mentioned above may include any of the features of any of the other aspects mentioned above and may include any of the features of any of the embodiments described below as appropriate.

BRIEF DESCRIPTION OF THE DRAWINGS

The accompanying drawings, which are incorporated in and constitute a part of this specification, illustrate various implementations of the invention and, together with the description, serve to explain the advantages and principles of the invention. In the drawings.

LIST OF COMPONENTS

Figure 1:
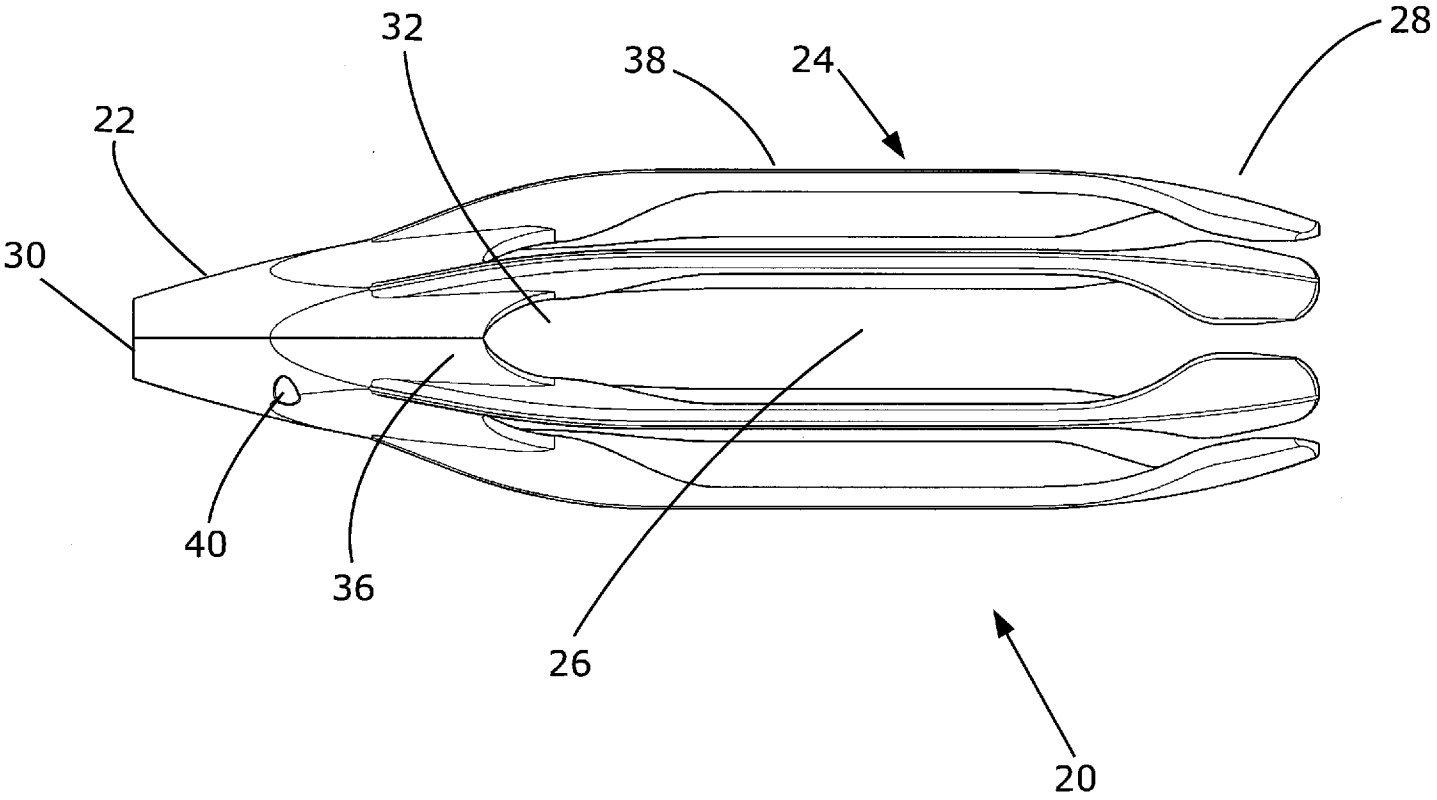
FIG. 1 is a side view of a sprinkler protector according to a preferred embodiment of the invention.

20 Sprinkler protector
22 Housing
24 Fingers
26 Cylindrical space
28 Paddles
30 Circular aperture
32 Arches
34 Finger shoulders
36 Base of conical housing
38 Vertical edges
40 Threaded inner bores
42 Screw
44 Drop pipe
46 Sprinkler body
48 Sprinkler head

DETAILED DESCRIPTION OF PREFERRED EMBODIMENT

The following detailed description of the invention refers to the accompanying drawings. Wherever possible, the same reference numbers will be used throughout the drawings and the following description to refer to the same and like parts. Dimensions of certain parts shown in the drawings may have been modified and/or exaggerated for the purposes of clarity or illustration.

Self-propelled mechanical moving irrigation systems such as a centre pivot or lateral irrigation system have a central irrigation conduit or water supply pipe which is supported on a wheeled driven frame adapted to move across a field. The central water supply conduit has a plurality of sprinkler heads attached thereto in a spaced relationship to one another. It is common for these sprinkler heads to be attached to the central water supply conduit by pipes or drops which extend downwardly from the conduit in order to lower the sprinkler head to close proximity with the crops. Some of the drops may be several meters in length.

Turning now to the drawings there is illustrated in FIG. 1 a sprinkler protector 20 comprising a conical housing 22 and a plurality of fingers 24 projecting outwardly therewith to create a cylindrical 26 space within the fingers. The base of the fingers 24 splay outwardly to form oblate flattened paddles or spoons 26 which taper inwardly to slightly enclose the cylindrical space and form a cage-like area. The paddles 26, are of an arrangement which leaves the bottom of the cage or shroud open, allowing for a user to insert their fingers or hand into the cylindrical space 26 and reach the sprinkler head.

The conical housing 22 may be hollow and adapted to fit over a drop or pipe and secure the sprinkler protector 20 to the sprinkler. As such, the conical housing 22 has a circular aperture 30 at its apex. The base of the housing 36 is hexagonal and comprises equilateral arches 32. The fingers 24 extend downwardly between each arch 32 and the finger shoulders 34 extend upwardly over the base of the conical housing 36 to provide additional strength and reinforcement to the fingers 24.

The fingers 24 contain vertical edges 38 and form a cage around the cylindrical space 26. The paddles 28 are rotated 180 degrees from the vertical edges to provide a flat surface or side flaps. Thus the sprinkler protector 20 is attached to the drop and/or base of the sprinkler and the sprinkler head is enclosed within the cylindrical space 26 created by the fingers 24. The sprinkler head is therefore protected from foreign objects such as fences as the fingers 24 act as a shroud by absorbing the impact from such material. The fingers 24 also act as a barrier against organic material such as plants, crops and mud from clogging the sprinkler head. They also protect the sprinkler head from livestock damage, as the fingers 24 shield the sprinkler head from either impact against animals in the field, and also prevent animals from attempting to chew or otherwise damage the sprinkler.

The fingers 24 allow the sprinkler protector 20 to be self-cleaning as any residual mud attached to the fingers 24 will be washed away by the spray of the water from the sprinkler head. In preference, there are six fingers evenly circumferentially spaced around the hexagonal base 36 although it is to be understood that this number can vary without deviating from the scope of the invention. The self-cleaning design also prevents damage to crops which may be caused by sprinkler heads alone or alternate protector shrouds. The protector 20 is able to pass through crops without ripping seeds off the tops of the crops or damaging other plants.

Figure 3:
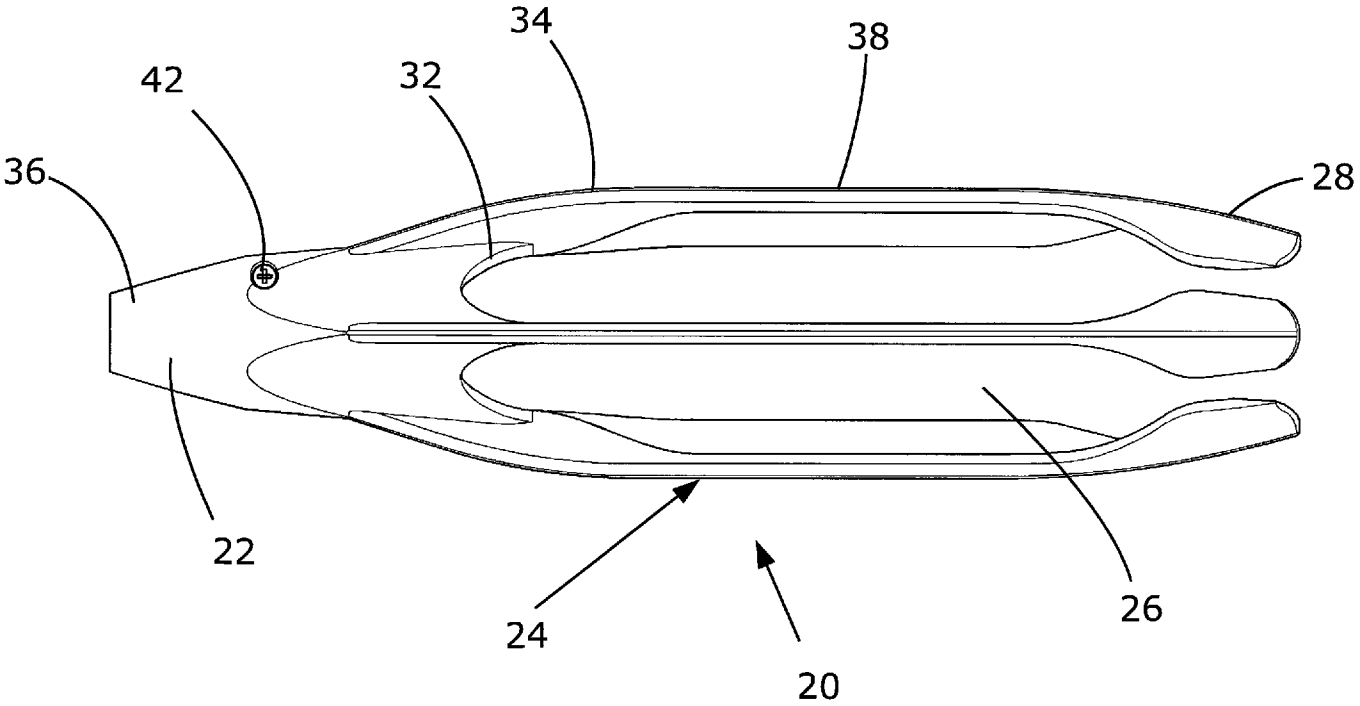
FIG. 3 is a front view of a sprinkler protector according to a preferred embodiment of the invention.

In a preferred embodiment of the invention the sprinkler protector is constructed from two symmetrical parts, each half having a co-axial threaded inner bore 40 through which a screw 42 can be inserted to connect the pieces together. Illustrated in FIG. 3 is the sprinkler protector 20 with both halves connected by the screw 42.

An alternative embodiment of the invention includes the two halves manufactured as one piece, with one edge moulded and already joined together and clip closed on the other edge. This would allow the user to simply clip the protector 20 around the drop pipe and sprinkler quickly and easily on site without the need to use screws and or separate joining means. It is to be understood that alternative methods of joining together to two halves may be made without deviating from the scope of the invention.

Although the preferred embodiment of the invention consists of two halves as hereinfore described, it is to be understood that the protector can be manufactured in other ways and can comprise one piece or multiple segments, for example, that may be hinged to wrap around the drop pipe. It is to be understood that the scope of the invention includes any method of manufacture, shape of shroud or assembly thereof.

Figure 2:
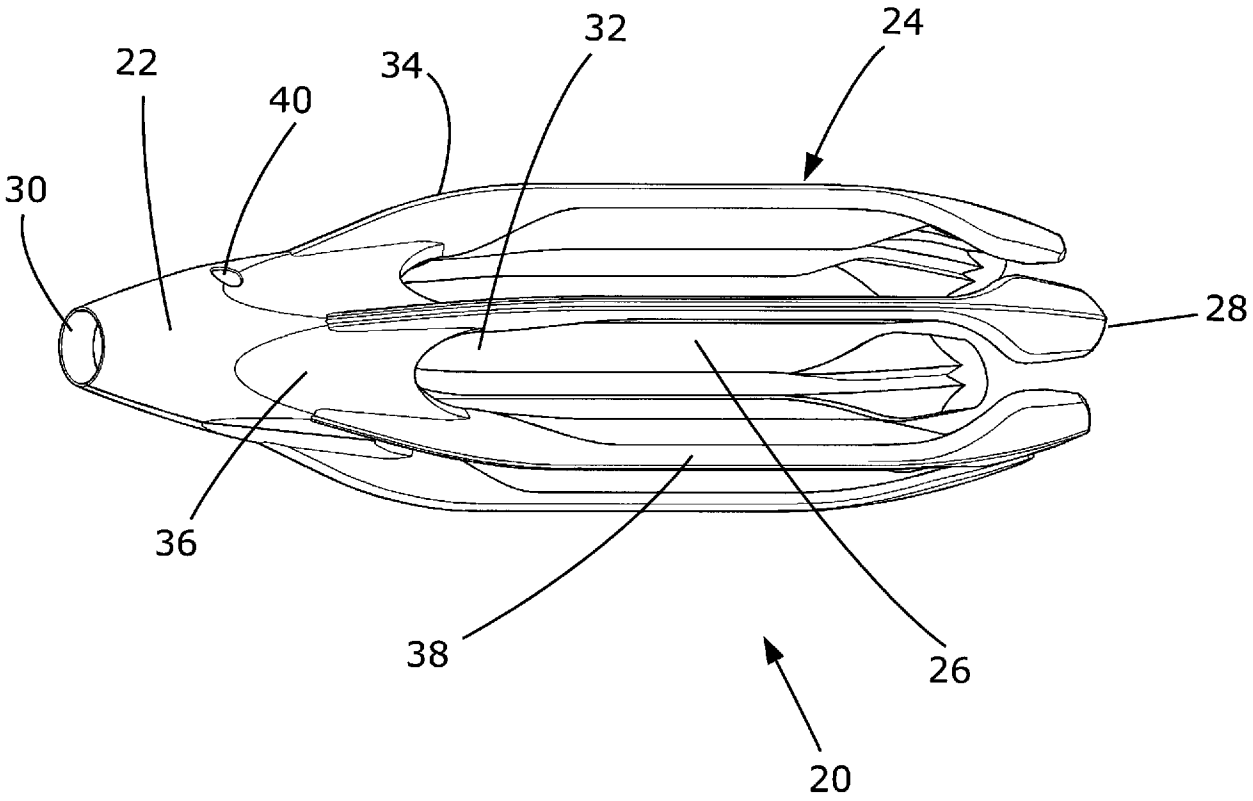
FIG. 2 is a perspective view of a sprinkler protector according to a preferred embodiment of the invention.

There is illustrated in FIG. 2 a perspective view of the sprinkler protector 20 in which the cage-like shroud is clearly represented. The fingers 24 are comprised of thin webs which are inwardly tapered towards the cylindrical space 26 and sprinkler head. This is to minimise the surface area directly around the sprinkler head itself to ensure that an excess of water does not impact the fingers 24 and is prevented from escaping the protector 20. The water is thus ejected from the sprinkler head and bounces off the tapered edges of the fingers 24 and flows outwardly over the crops. Thus, while the protector 20 acts as a barrier against external materials, it does not prevent the efficient escape of the water from the sprinkler to irrigate the field.

The nature of crop fields is that there may be uneven surfaces or small hills over which the irrigation system must travel. As such the sprinkler is not always positioned above the crops which may result in the sprinkler head being dragged horizontally along the ground as the system travels over hills or built-up patches of earth. Earth, mud and plant debris can therefore directly impact the sprinkler head, causing damage or blockages as the mud builds up around the sprinkler.

The spacing of the fingers 24, the finger shoulders 34 and the vertical edges 38 therefore elevate the sprinkler head 48 and maintain a consistent distance of the sprinkler assembly from the ground, ensuring that there is less mud ingress or plant material which can get caught in the sprinkler. The paddles 28 provide a greater surface area on which the sprinkler can be dragged, and therefore strengthening the protector against breakages and preventing mud from impacting against the sprinkler head.

It is also possible that the sprinkler may not be dragged horizontally, but dragged on an angle with some part of the sprinkler still impacting the ground. The placement of the paddles 28 below the sprinkler head and forming a cage-like shape therewith ensures that the protector 20 absorbs the impact from the ground and keep the sprinkler head away from the dirt, mud or grassed surface, and thus acts as a centering device. The paddles are specifically designed so that it gives the greatest surface area to slide along the top of the ground, and does not cut into the ground. This prevents mud from catching in the fingers 24 and the mud simply slides off the greater surface area of the paddles 28 and does not become clogged.

The weight of the paddles and the overall design to the sprinkler is also directed to prevent or minimise spinning of the sprinkler head within the protector 20, and/or spinning of the protector 20 around the sprinkler head.

The protector 20 also encapsulates the sprinkler head to prevent damage should the irrigation system impact solid materials in fields such as fences, machines or tractors. Occasionally the sprinklers may also knock against one another due to movement of the irrigation systems and drop pipes and the protector 20 also prevents impact of the sprinkler heads and thus protects against damage.

FIGS. 1, 2 and 3 clearly demonstrate the slimline design of the sprinkler protector 20. While the fingers may contain shoulders, there are no shoulders on the housing itself or any other external catching points which may become caught in crops or other materials. The neck of the housing 22 smoothly runs into the finger shoulders 34 to create a streamline appearance and design. Thus, foreign material will not become caught in the sprinkler protector 20.

Figure 4:
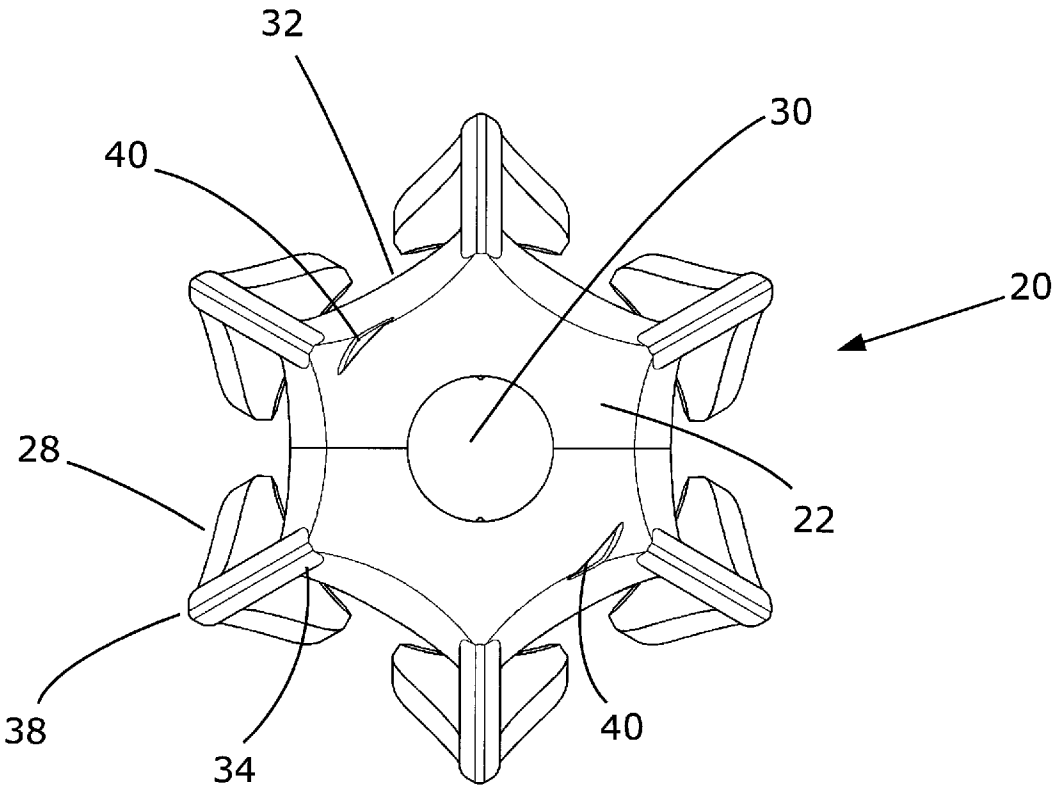
FIG. 4 is a top view of a sprinkler protector according to a preferred embodiment of the invention.

FIG. 4 illustrates a top view of the sprinkler protector 20, the view being from the top of the housing 22 looking downwardly through the housing 22 and circular aperture 30. The placement of the threaded inner bores 40 can clearly be seen in this figure, wherein the screw 42 can be inserted through the bore 40 to secure the two halves of the housing 22 together and secure the housing 22 to the drop pipe. The hexagonal shape of the inner housing can also be seen, formed by the arches 32 and finger shoulders 34.

Figure 5:
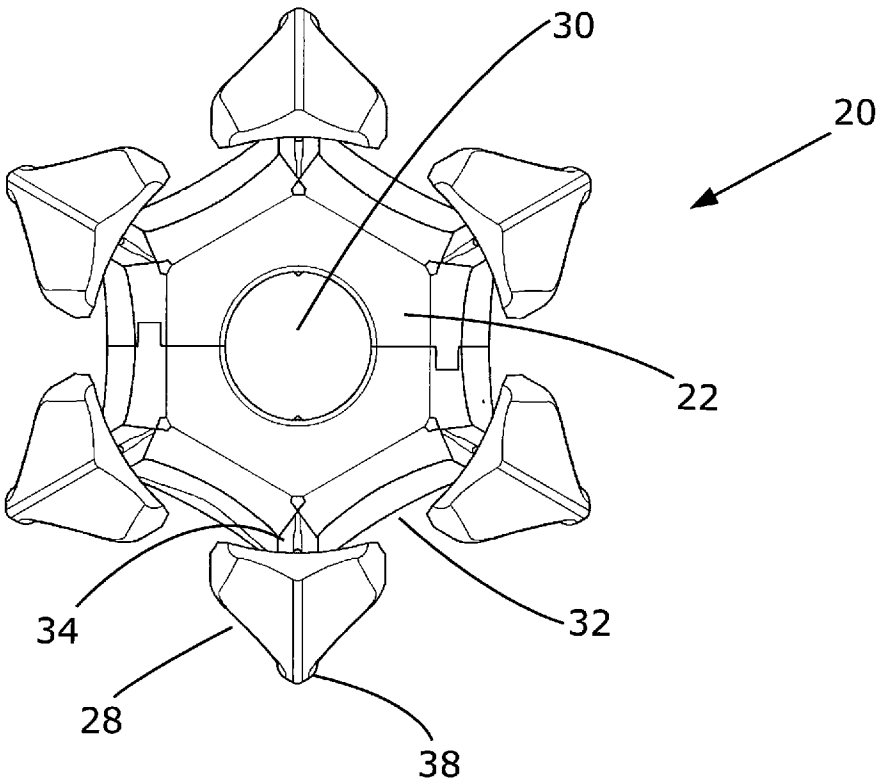
FIG. 5 is a bottom view of a sprinkler protector according to a preferred embodiment of the invention.

FIG. 5 illustrates a bottom view of the sprinkler protector 20 looking upwardly through the housing 22 and circular aperture 30. Two halves of the housing 22 which make up the body of the sprinkler protector 20 are connected through mating male and female keys located on the edge of each half of the housing 22. This figure also clearly illustrates the way in which the paddles 28 angle inwardly to create a cage-like shape within which the sprinkler is contained, however it can be seen that despite the inward angle of the paddles 28, there is still enough room for the user to access the cylindrical space 26. The paddles 28 are also slightly tapered to form a spoon-like shape which works to ensure that foreign materials such as plant matter simply slide off the paddles 28 after impact and do not become tangled within the protector 20 itself.

Figure 6:
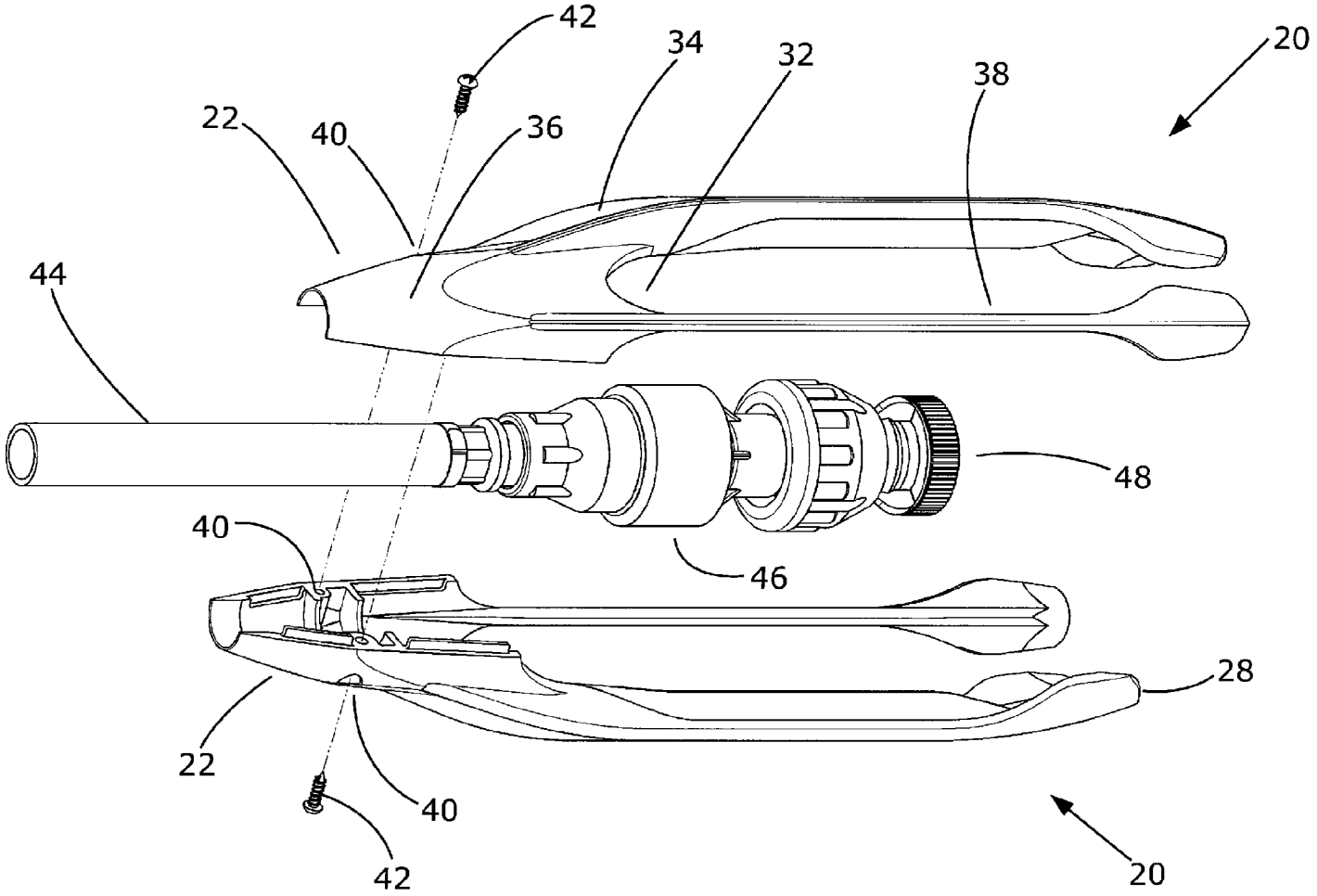
FIG. 6 is a perspective view of two halves of a sprinkler protector detached from a sprinkler accordingly to a preferred embodiment of the invention.

In FIG. 6 there is illustrated two halves of the sprinkler protector 20 as they are to be attached to the irrigation system comprising of a drop pipe 44, a sprinkler body 46 and a sprinkler head 48. Each half of the housing 22 is pressed together around the drop pipe 44, with the fingers 24 enclosing the sprinkler body 46 and head 48. Each half of the housing 22 contains a semi-circular flange which creates a ring around the drop pipe 44 when connected, securing the sprinkler to the protector 20, the two halves also connected via the mating of male and female keys below the ring. Each half of the housing also contains an internal bore 40 through which screws 42 can be threaded to secure the two halves into one housing 22. The screw is inserted through an aperture on the outside of the first half of the housing which extends through the ring and into an aperture contained in the second half of the housing 22. The second half of the housing also contains an aperture on the outside of the housing, positioned in the mirror image of the aperture on the first half of the housing. A second screw is therefore inserted through the aperture on the second half of the housing 22, which extends through the ring and into an aperture contained in the first half of the housing. Thus, both halves of the housing contain a threaded internal bore 40 through which a screw 42 can be inserted to attach both halves of the housing 22 together. Again, it is to be understood that this is only one embodiment of the invention and that the two halves can be connected in any way, or the protector can comprise a single piece, or be constructed from any number of segments.

Figure 7:
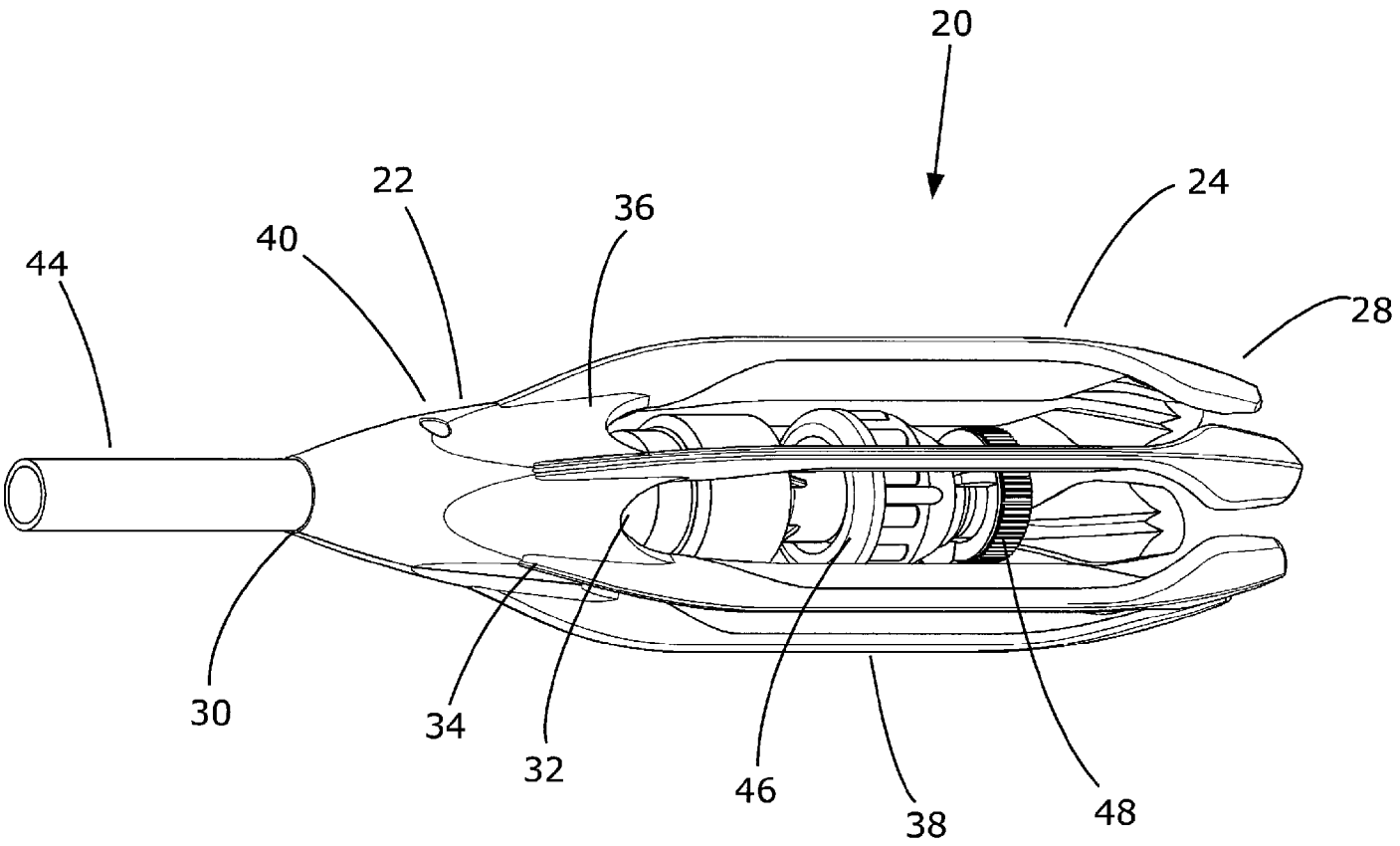
FIG. 7 is a perspective view of the sprinkler protector attached to a sprinkler according to a preferred embodiment of the invention.

FIG. 7 illustrates the sprinkler protector 20 as assembled and containing the sprinkler in a preferred embodiment of the invention. The housing 22 is securely fastened to the drop pipe 44, which extends through the conical aperture 30. The sprinkler body 46 and sprinkler head 48 are contained within the cage-like shroud formed by the fingers 24 and the paddles 28. The sprinkler head 48, however, is in line with the vertical edges 38 of the fingers 24 and thus while the sprinkler is protected from foreign materials; the fingers are narrow enough so that the sprinkler is still efficient and water is not wasted through impact with the fingers. The paddles 28 have a greater surface area however are not in line with the stream of water which sprays from the sprinkler head 48. The protector 20 therefore absorbs any impact from outside force such as a fence and also prevents plant material from being caught by the sprinkler head and clogging the stream of water.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus. Any discussion of the prior art throughout the specification should in no way be considered as an admission that such prior art is widely known or forms part of the common general knowledge in this field.

In the summary of the invention, except where the context requires otherwise due to express language or necessary implication, the word "comprising" is used in the sense of "including", i.e. the features specified may be associated with further features in various embodiments of the invention.

The invention claimed is:

1. A sprinkler protector comprising:

a housing; wherein the housing defines an aperture at an apex thereof and said aperture encloses a drop pipe;

a plurality of circumferentially disposed fingers extending outwardly from the housing, wherein each of the fingers has a first end and a terminal end; wherein the first end is engaged with the housing and the terminal end is spaced a distance longitudinally outwardly from the housing, wherein each finger has a length measured from the first end to the terminal end; wherein the first end of each of the fingers is engaged with the housing; wherein a gap is defined between adjacent fingers and the gap is closed at the first ends of the fingers and the gap is open at the terminal ends of the fingers; wherein adjacent fingers are spaced a distance away from each other along substantially their entire lengths, wherein said protector is adapted to enclose a sprinkler attached to the drop pipe and the fingers are arranged to encircle a sprinkler head and extend for a distance outwardly beyond an outermost end of the sprinkler head; and wherein the fingers are comprised of radially extending webs from a center axis inwardly tapered towards the sprinkler;

wherein the protector is constructed from first and second identical halves, each containing a semi-circular flange, a threaded inner bore, the first half containing a male key and the second half containing a female key, wherein when the first and second halves are assembled to form the protector, the flanges create a ring around the drop pipe, the male and female keys are mated and the first and second halves are secured together; and wherein the terminal end of each finger comprises a paddle; wherein each paddle comprises a curved surface with an inner side that is concave and having a vertical axis that is greater in length than its horizontal axis; and wherein; each of said paddles is located transversely to a distal end of the associated web; and wherein the gap is defined between adjacent paddles.

2. The sprinkler protector according to claim 1, wherein the housing is conical, a base portion of the housing is hexagonal and comprises equilateral arches, and said fingers extend outwardly between each arch.

3. The sprinkler protector according to claim 2, wherein said fingers contain shoulders extending upwardly over the base portion of the housing.

4. The sprinkler protector according claim 3, wherein a neck portion of the housing smoothly forms into the shoulder of said fingers.

5. The sprinkler protector according to claim 1, wherein a base portion of the housing contains the fingers, and wherein the fingers are six evenly circumferentially spaced fingers extending downwardly from the base portion and forming a cylindrical space therein; and wherein the cylindrical space is sized to receive the sprinkler head therein and when the sprinkler head is engaged with the sprinkler protector the sprinkler head is centrally received between the fingers.

6. The sprinkler protector according to claim 1, wherein the fingers elevate the sprinkler away from an impacting surface.

7. The sprinkler protector as defined in claim 1, wherein the fingers are evenly spaced apart from each other.

8. A sprinkler protector comprising:

a housing; wherein the housing contains an aperture at an apex thereof and said aperture encloses a drop pipe;

a plurality of circumferentially disposed fingers extending from the housing, wherein the fingers are evenly spaced apart from each other; and each finger has a first end that is engaged with the housing, wherein said protector is adapted to enclose a sprinkler and said fingers are adapted to enclose a sprinkler head of the sprinkler and to extend outwardly for a distance beyond the sprinkler head; and wherein the fingers are comprised of radially extending webs from a center axis inwardly tapered towards the sprinkler;

wherein the protector comprises first and second identical halves with a molded hinge joining the first and second halves on one side of the housing and a connecting clip adapted to join the non-molded sides of the housing together enclosing the sprinkler; and wherein each finger includes a terminal end remote from the housing; and wherein a gap is defined between adjacent fingers and the gap is closed proximate the first ends of the fingers and is open proximate the terminal ends of the fingers; and wherein the terminal end of each finger is of a greater width than a remaining portion of the finger that extends between the terminal end and the first end; and wherein the fingers further comprise paddles and each paddle comprises the terminal end of the associated finger; each of said paddles being located transversely to a distal end of the associated web; and wherein a gap is defined between adjacent paddles.

9. The sprinkler protector according to claim 8, wherein the housing is conical, a base portion of the housing is hexagonal and comprises equilateral arches, and said fingers extend downwardly between each arch.

10. The sprinkler protector according to claim 9, wherein said fingers contain shoulders extending upwardly over the base portion of the housing.

11. The sprinkler protector according claim 10, wherein a neck portion of the housing smoothly forms into the shoulder of said fingers.

12. The sprinkler protector according to claim 8, wherein a base portion of the housing contains the fingers, and wherein the fingers are six evenly circumferentially spaced fingers extending downwardly from the base portion and forming a cylindrical space therein and wherein a space is defined between each pair of adjacent fingers.

13. The sprinkler protector according to claim 8, wherein the fingers elevate the sprinkler away from an impacting surface.

14. A sprinkler protector comprising:

a housing;

a plurality of circumferentially disposed fingers extending from the housing; and wherein the fingers each have a first end and a second end; and wherein the first ends of the fingers are joined together and are engaged with the housing; and wherein a gap is defined between adjacent fingers and the second ends are evenly spaced apart from each other; and wherein the gap is closed proximate the first ends of the fingers and is open proximate the second ends of the fingers;

wherein the protector is constructed from first and second halves, each half containing a semi-circular flange, a threaded inner bore, and mating keys; wherein the flanges create a ring around a drop pipe in the housing, the keys are mated and the first and second halves are connected together; and wherein the protector is adapted to enclose a sprinkler head and wherein the fingers are comprised of radially extending webs from a center axis inwardly tapered towards the sprinkler; and wherein the second ends of the fingers further comprise paddles; each of said paddles being located transversely to a distal end of the associated web; and wherein the gap is defined between adjacent paddles.

15. The sprinkler protector according to claim 14, wherein the housing is conical, a base portion of the housing is hexagonal and comprises equilateral arches, and said fingers extend downwardly between each arch.

16. The sprinkler protector according to claim 15, wherein said fingers contain shoulders extending upwardly over the base portion of the housing.

17. The sprinkler protector according claim 16, wherein a neck portion of the housing smoothly forms into the shoulder of said fingers.

18. The sprinkler protector according to claim 14, wherein a base portion of the housing contains the fingers, and wherein the fingers are six evenly circumferentially spaced fingers extending downwardly from the base portion and forming a cylindrical space therein.

19. The sprinkler protector according to claim 14, wherein the fingers elevate the sprinkler away from an impacting surface.

* * * * *